US006756986B1

(12) United States Patent
Kuo et al.

(10) Patent No.: US 6,756,986 B1
(45) Date of Patent: Jun. 29, 2004

(54) NON-FLUSHING ATOMIC OPERATION IN A BURST MODE TRANSFER DATA STORAGE ACCESS ENVIRONMENT

(75) Inventors: Dong-Ying Kuo, Pleasanton, CA (US); Derek C. Chang, Cupertino, CA (US)

(73) Assignee: S3 Graphics Co., Ltd., Cayman Islands (KN)

( * ) Notice: Subject to any disclaimer, the term of this patent is extended or adjusted under 35 U.S.C. 154(b) by 0 days.

(21) Appl. No.: 09/420,047

(22) Filed: Oct. 18, 1999

(51) Int. Cl.[7] ..... G09G 5/39
(52) U.S. Cl. ..... 345/531; 345/422; 345/572
(58) Field of Search ..... 345/422, 501, 345/564, 530, 531, 536–558, 572; 711/100, 154, 155, 200

(56) References Cited

U.S. PATENT DOCUMENTS

| | | | | |
|---|---|---|---|---|
| 5,230,064 A | | 7/1993 | Kuo et al. | 395/162 |
| 5,299,309 A | | 3/1994 | Kuo et al. | 395/162 |
| 5,388,207 A | | 2/1995 | Chia et al. | 395/164 |
| 5,852,451 A | | 12/1998 | Cox et al. | 345/509 |
| 5,864,512 A | | 1/1999 | Buckelew et al. | |
| 5,937,204 A | | 8/1999 | Schinnerer | |
| 5,945,997 A | | 8/1999 | Zhao et al. | 345/430 |
| 5,948,081 A | | 9/1999 | Foster | |
| 6,166,743 A | * | 12/2000 | Tanaka | 345/422 |
| 6,329,997 B1 | * | 12/2001 | Wu et al. | 345/519 |

* cited by examiner

*Primary Examiner*—Kee M. Tung
(74) *Attorney, Agent, or Firm*—Carr & Ferrell LLP

(57) ABSTRACT

A z-unit for a three-dimensional graphics system is provided having a read buffer and a write buffer. The read buffer stores read requests and the write buffer stores write requests. The read and write requests correspond to atomic operations for z-buffer manipulations. Upon the receipt of a read request, the address of the read request is compared to each of the addresses of the write requests. If a match occurs then the read buffer is flushed until a first read request with the matched address occurs. The write buffer is then flushed and all the write requests within the write buffer is serviced. The read buffer is again flushed until all the read requests within the read buffer is serviced.

16 Claims, 7 Drawing Sheets

NON-FLUSHING ATOMIC OPERATION IN A BURST MODE TRANSFER DATA STORAGE ACCESS ENVIRONMENT

BACKGROUND OF THE INVENTION

The present invention relates to graphics generation and display systems and methods, and more particularly, to methods and systems of performing non-divisible memory operations for accessing a z-buffer during the generation and display of three-dimensional graphical images in a burst mode transfer data storage environment.

In many modern computers or computerized systems, a graphics display system provides a display device along with memory and a processor to display graphical images. The display device generally includes a pixel-oriented output device that displays a plurality of pixels, a pixel being the smallest addressable element in the output device. Examples of a pixel-oriented output devices include CRT monitors, LCD displays, and the like. The individual pixels on the output device are addressed using x and y coordinates, in the same manner as points on a graph are addressed.

The memory includes a frame buffer. The frame buffer stores a pixel number map corresponding to the graphical image displayed on the output device. The pixel number map is generally represented by a grid-like array of pixels where each pixel is assigned a color and a shade value. The processor computes and updates the pixel values in the frame buffer when a new graphical image is to be displayed. In processing a three-dimensional graphical object, the depth attribute of the object must be considered prior to the updating of any pixel values in the frame buffer. If the new object being processed is located behind and is partially obscured by the displayed object, only a visible portion of the new object should be displayed. On the other hand, if the new object is completely obscured by the displayed object, no updates to the frame buffer are necessary and the new object is not displayed.

Three-dimensional objects are often represented by a set of vertices defining polygon surfaces. Each vertex is defined by x, y, and z dimensions corresponding to the X, Y, and Z axes. The X and Y axes define a view plane and the Z axis represents a distance from the view plane. A z coordinate value, therefore, indicates the depth of an object at a pixel location defined by specific x and y coordinates.

Therefore, in a three-dimensional graphics display system, the memory also includes a z-buffer. The z-buffer stores the z-value of each pixel, and hence, the depth value of each pixel, and permits performance of depth analysis of a three-dimensional object. This process is often referred to as a "hidden surface removal process." When a new object moves into a displayed portion of the view plane, a determination must be made as to whether the new object is visible and should be displayed, or whether the new object is hidden by objects already in the displayed portion of the view plane. The determination of whether the new object should be displayed is generally done on a pixel-by-pixel basis.

Thus, for each pixel, defined by x-y coordinates, the depth, or z-value, of the new object is compared to the depth, or z-value, of the currently displayed object. If the comparison indicates that the new pixel to be drawn is in front of the old pixel in the z-buffer (i.e., the new z-value is less than the old z-value), the old z-value is replaced with the new z-value, and red, blue, green and intensity values for the new pixel are written to the frame buffer for being displayed in the place of the old pixel. On the other hand, if the new pixel is located behind the old pixel, it will be hidden from view and need not be displayed. In this situation, the old z-value is kept in the z-buffer and the new z-value is discarded. The old pixel remains displayed and is not replaced by the new pixel.

The pixel-by-pixel analysis during the display or rendering of an object requires a z-buffer read for each pixel to compare the z-value of the old pixel with respect to the new pixel. Additionally, a conditional update of the z-buffer is required based on the comparison of the z-values. Because z-buffers are large and cannot be stored on-chip, thereby requiring external memory access, such z-comparisons and updates significantly slow down the rendering process. However, many advancements with memory technology to increase the speed of memory access, and thus the pixel-by-pixel analysis, have been achieved. In particular, one advancement to increase the speed of memory access that is often utilized is a burst mode transfer technique.

Burst mode transfer combines individual read requests and write requests to memory into aggregates, with each aggregate being formed of many individual read requests or write requests. Burst mode transfer sends these aggregates in bursts, such that an aggregate of individual read requests are transferred followed by an aggregate of individual write requests. Therefore, groups of read or write requests can be serviced at the same time instead of individually and thus be serviced quicker. The order of the individual read requests in relation to the individual write requests, however, is not necessarily maintained.

Thus, if the device is transmitting information sequentially loaded into an area in memory, the order in which the information is received may not be the order in which it was sequentially loaded into memory. In other words, z-buffering operations that perform the hidden surface removal process may not operate as intended. The z-buffering operations include numerous atomic operations. An atomic operation is a read-modify-write request performed in a non-divisible manner. As such, data at times needs to be fetched, modified and written back to the same memory location in the z-buffer in an ordered fashion to maintain memory coherency. However, during a burst mode transfer, memory coherency, i.e., the order in which data is stored in memory, can be disrupted.

For example, a first read-modify-write and a second read-modify-write request each directed to the same memory location in the z-buffer are received. Upon a burst mode transfer occurring, two read requests corresponding to the first and second read-modify-write requests are serviced prior to the two write requests. Therefore, the second read request in the first read-modify-write request is performed prior to the first write request in the read-modify-write request, and thereby disrupting the coherency of the data stored in the z-buffer. The lack of data coherency causes invalid data to be used. Since both read-modify-write requests are directed towards the same memory location, the second read request will read data that otherwise would have been modified by the first write in the first read-modify-write request if both read-modify-write requests were performed in atomic order.

The use of both burst mode transfer technology and atomic operations is therefore problematical. Burst mode transfer technology requires that at times information be transmitted in an order possibly different from that otherwise expected by the sender. The use of atomic operations, on the other hand, requires that received requests be in a predefined order with respect to the atomic operations. Accordingly, methods and systems which overcome the obstacles of using of both burst mode transfer technology and atomic operations are desirable.

SUMMARY OF THE INVENTION

The present invention provides a method of performing non-divisible operations, a non-divisible operation includes a read request and a write request, in a burst mode transfer storage environment of a graphics system. The method includes the process of receiving an individual read request in a non-divisible operation. The received individual read request contains address information. The method also includes comparing address information in the received read request to address information contained in previous read requests received. The method services the previous read requests when the address information contained in the received individual read request corresponds to the address information contained in one of the previous read requests. The method halts the servicing of the previous read requests when the one of the previous read requests is serviced. The method then continues by servicing previous write requests in a second buffer until the second buffer is empty.

In another embodiment, the present invention provides a method of performing non-divisible operations in a burst mode transfer storage environment of a graphics system. The method includes the process of receiving a plurality of non-divisible operations that include a plurality of read requests and a plurality of write requests. Each of the plurality of read requests contain address information. When address information in a first one of the plurality of read requests corresponds to address information contained in a second one of the plurality of read requests, the method services the plurality of read requests. The method halts the service of the plurality of read requests when the first one of the plurality of read requests is serviced and then services the plurality of write requests. The method then restarts the service of the plurality of read requests when all the plurality of write request have been serviced.

In another embodiment, a z-unit coupled to a graphics engine and a memory is provided. The z-unit includes a z-render block generating addresses from signals received from a graphics engine. Also, the z-unit includes a z-read buffer storing read addresses and a z-write buffer storing write addresses. Furthermore, the z-unit includes z-history block tracking the generated addresses to ensure that memory corresponding to the write addresses are updated properly in relation to the read addresses.

In another embodiment, a three-dimensional graphics system operating in a burst mode transfer storage environment is provided. The three-dimensional graphics system includes memory that includes a z-buffer. The memory is configured to transfer data in groups corresponding to a memory bus width. A graphics engine coupled to the memory and configured to initiate non-divisible operations. Also, a z-unit, coupled to the graphics engine and the memory, is configured to interpret the non-divisible operations and execute the non-divisible operations in conjunction with the memory in a predetermined order.

Many of the attendant features of this invention will be more readily appreciated as the same becomes better understood by reference to the following detailed description and considered in connection with the accompanying drawings in which like reference symbols designate like parts throughout.

DETAILED DESCRIPTION OF THE INVENTION

Figure 1:
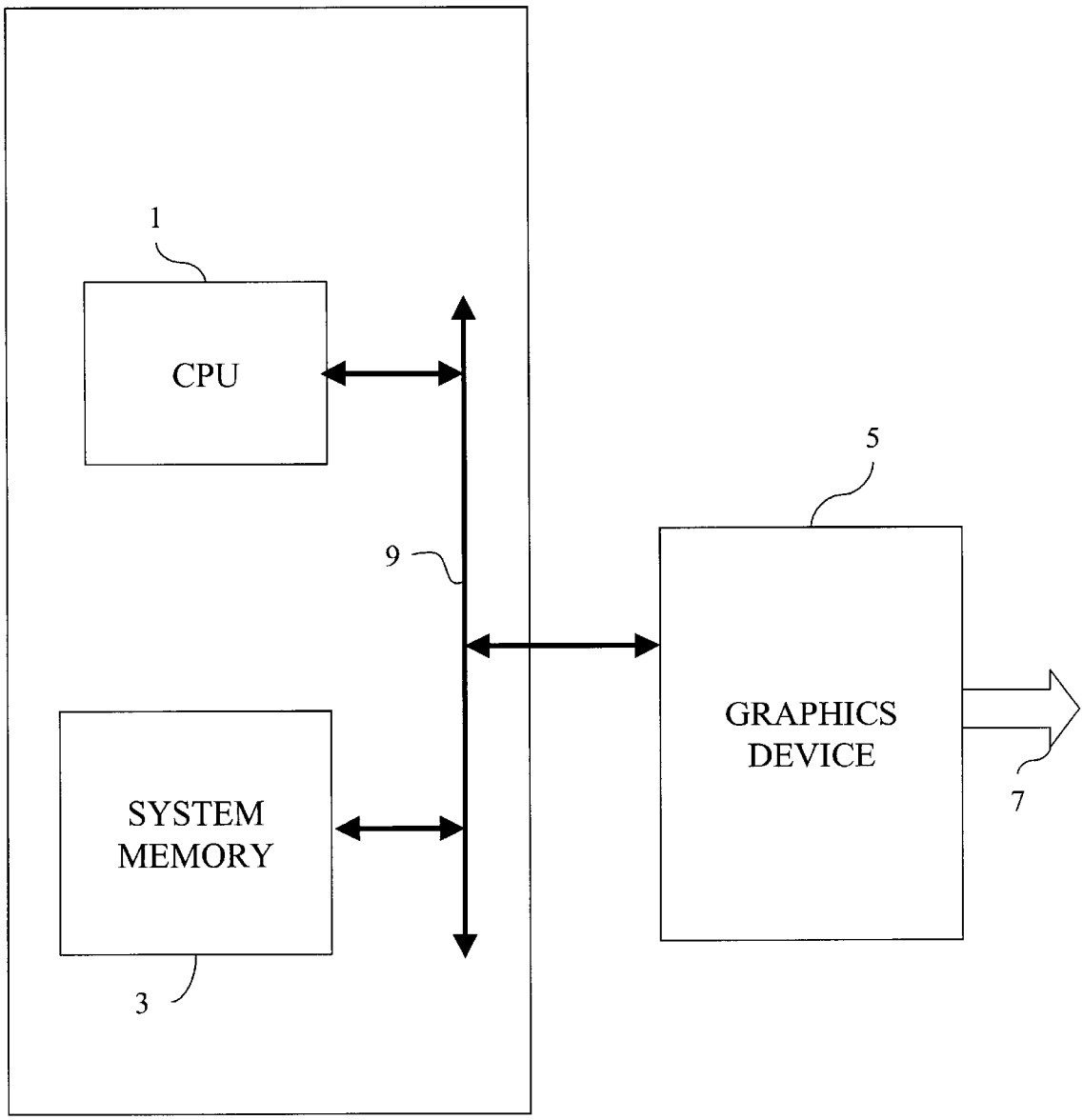
FIG. 1 is a simplified block diagram of a computer graphics system.

FIG. 1 illustrates a simplified block diagram of a computer graphics system. The computer graphics system includes a processor 1, system memory 3 and a graphics device 5. The processor 1 is coupled to the system memory 3 and the graphics device 5 though a system bus 9. The processor 1 executes program instructions, i.e., a software application, stored in the system memory 3 to perform various functions. One particular software application stored in the system memory and executed by the processor is a graphics driver. The graphics driver acts as a translator between the graphics device 5 and other software applications stored in the system memory, such as an application program that requires graphical images to be displayed. The graphics device 5 produces graphical output signals 7 to a graphical display device, such as a monitor, to visually display the graphical images as required by the application program. Hence, the graphics device 5 acts as a "middleman" between the monitor and the application programs.

Figure 2:
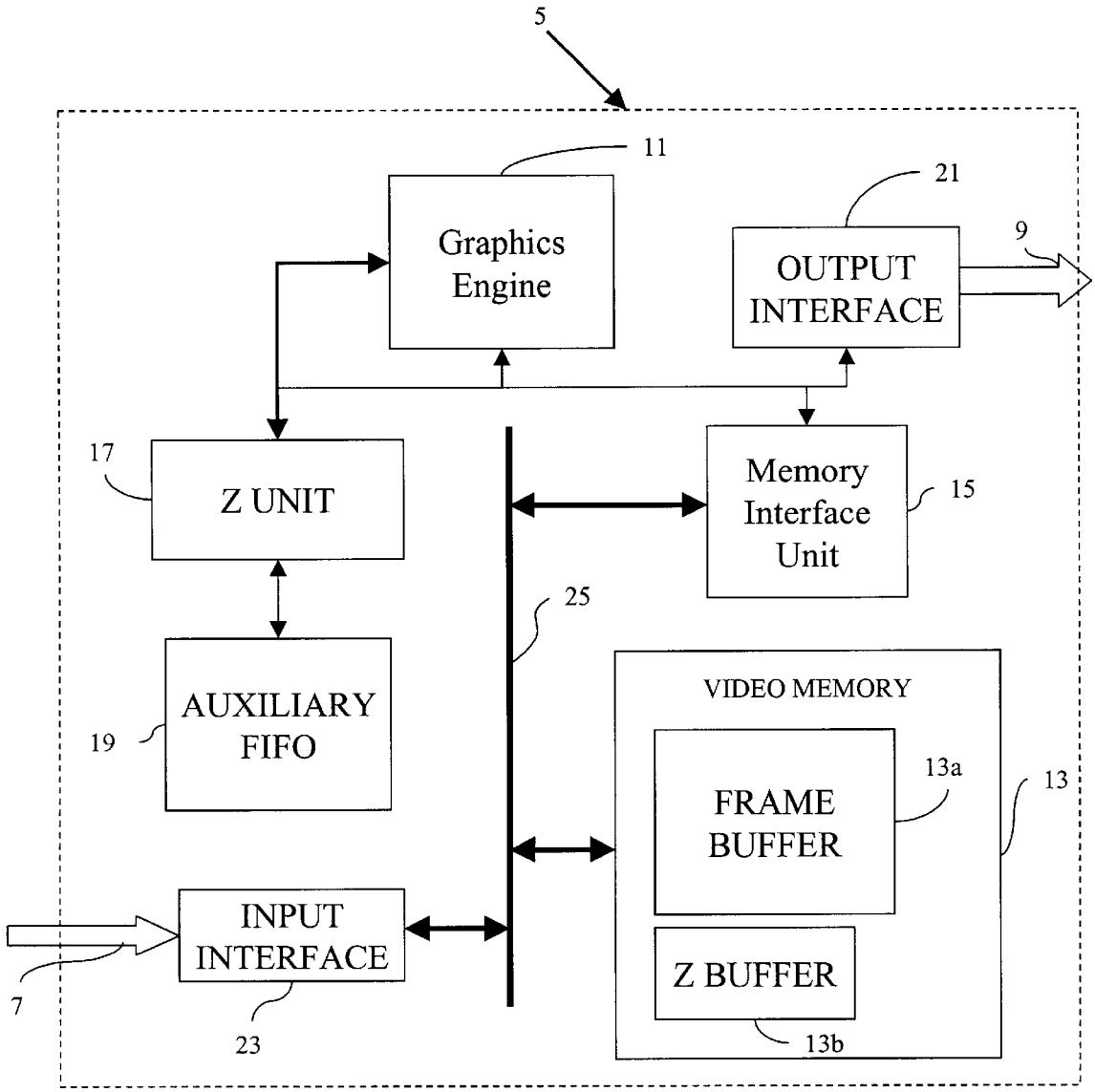
FIG. 2 is a semi-schematic of one embodiment of the graphics device of the present invention.

In FIG. 2, the graphics device 5, generally, includes a graphics engine 11, video memory 13, a memory interface unit 15, a graphics output interface 21 and a graphics input interface 23. The graphics engine 11 receives drawing commands from the processor 1 (FIG. 1) through the graphics input interface 23. The graphics engine executes a series of computations based on the received drawing commands. The video memory 13 includes a frame buffer 13*a* and a z-buffer 13*b*. The memory interface unit 15 is a gatekeeper that controls the access to the video memory 13 and, therefore, also access to the frame buffer and the z-buffer. The memory interface unit 13 and the video memory 13 are commonly coupled to a memory bus 25.

The video memory, in one embodiment, includes synchronous dynamic random access memory (SDRAM) and synchronous graphic random access memory (SGRAM). In the embodiment described, the video memory is configured to operate in a burst mode transfer manner. Therefore, data is transferred in aggregates by automatically fetching groups of data from the video memory 13. For example, upon the receipt of a first data request, data contained in successive locations in the video memory is automatically retrieved along with the first data requested. In one embodiment, the memory bus 25 has a data width of 128 bits. In this embodiment, data is grouped into 128 bit aggregates to fill the memory bus. Similarly, the memory interface unit 15 is also configured to operate in a burst mode transfer manner in conjunction with the video memory.

From the computations performed by the graphics engine, the graphics engine 11 determines and stores pixel values of the graphical image to be displayed into the frame buffer. The graphics output interface 21 fetches or reads the pixel values stored in the frame buffer. The graphics output interface acts as a Random Access Memory Digital to Analog Converter (RAMDAC). Acting as a RAMDAC, the graphics output interface converts the pixel values stored in the frame buffer into analog output signals 9. The analog output signals are then provided to a display output device (not shown) for displaying the graphical images. Similar to the frame buffer, the Z values (depth) of the graphical image are stored in the z-buffer. However, a z-unit 17 in the graphics device 5 acts as a controller in charge of any z-buffer manipulations requested by the graphics engine. In addition, to process the z-buffer manipulations, the z-buffer utilizes an auxiliary First In, First Out (FIFO) 19. In one embodiment, the auxiliary FIFO is configured to operate in a burst mode transfer manner.

Figure 3:
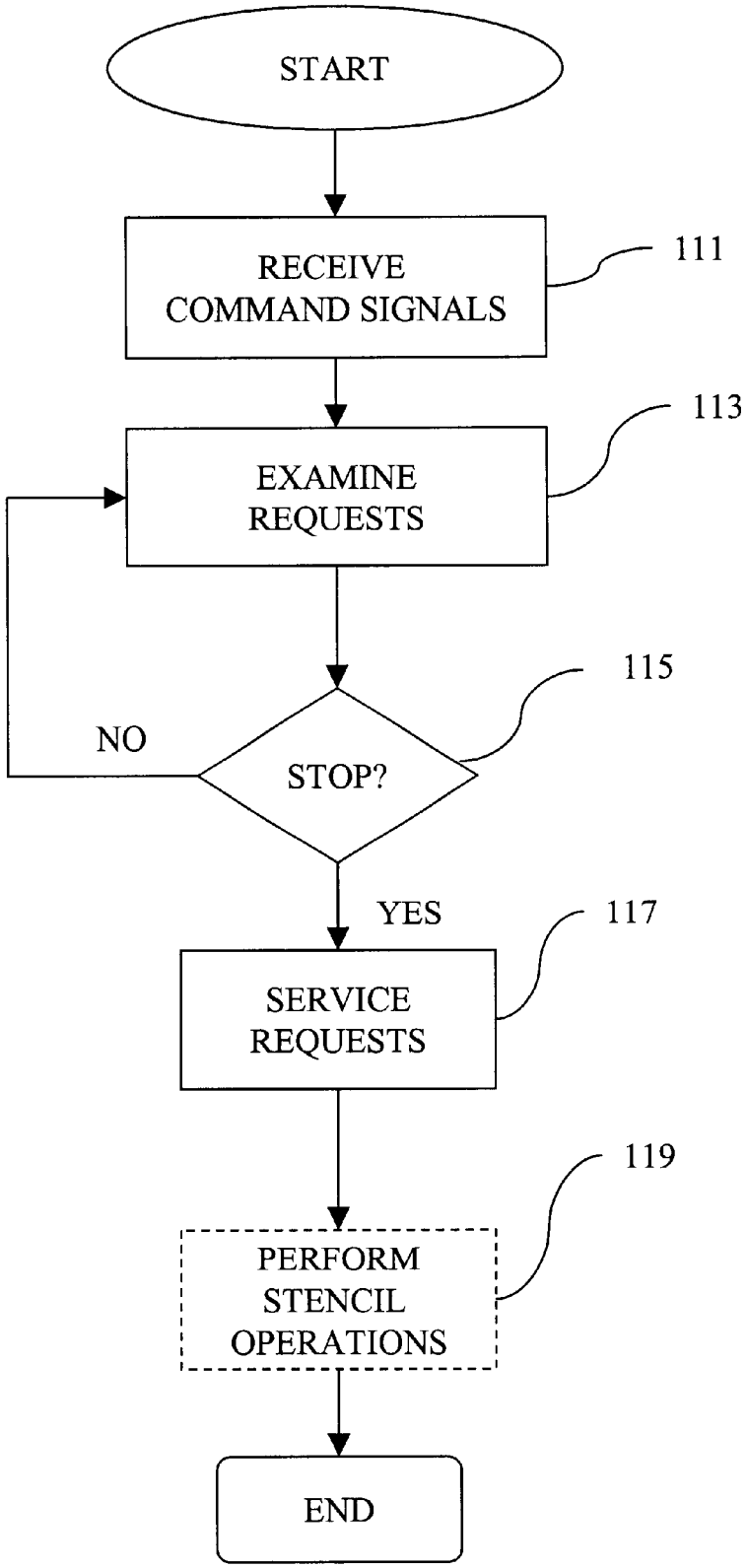
FIG. 3 is a flow diagram illustrating an overview of a process performing z-buffer manipulations of the present invention.

FIG. 3 illustrates an overview of the process performing z-buffer manipulations in the present invention. In box 111, the process receives signals from the graphical engine to conduct z-buffer manipulations. Z-buffer manipulations include a series of atomic or non-divisible operations including one or more read-modify-write request. A read-modify-write request contains an individual read and an individual write request. In box 113, the process examines each received read request and each received write request. In box 115, the process determines whether received read request meets a predetermined criterion. If the predetermined criterion is met, then the process, in box 117, services all the requests in a predetermined manner which is more fully described in reference to FIG. 4A. The process then ends.

In one embodiment, the predetermined criterion is a commonality between address locations defined in two or more separate read and write requests within two or more atomic operations. In another embodiment, the process does not end but continues after servicing the requests in box 117 to box 119. In box 119, the process compares window identifications to perform stencil operations and then the process ends. Stencil operations include the determination to display graphical images without affecting a background image.

Figure 4A:
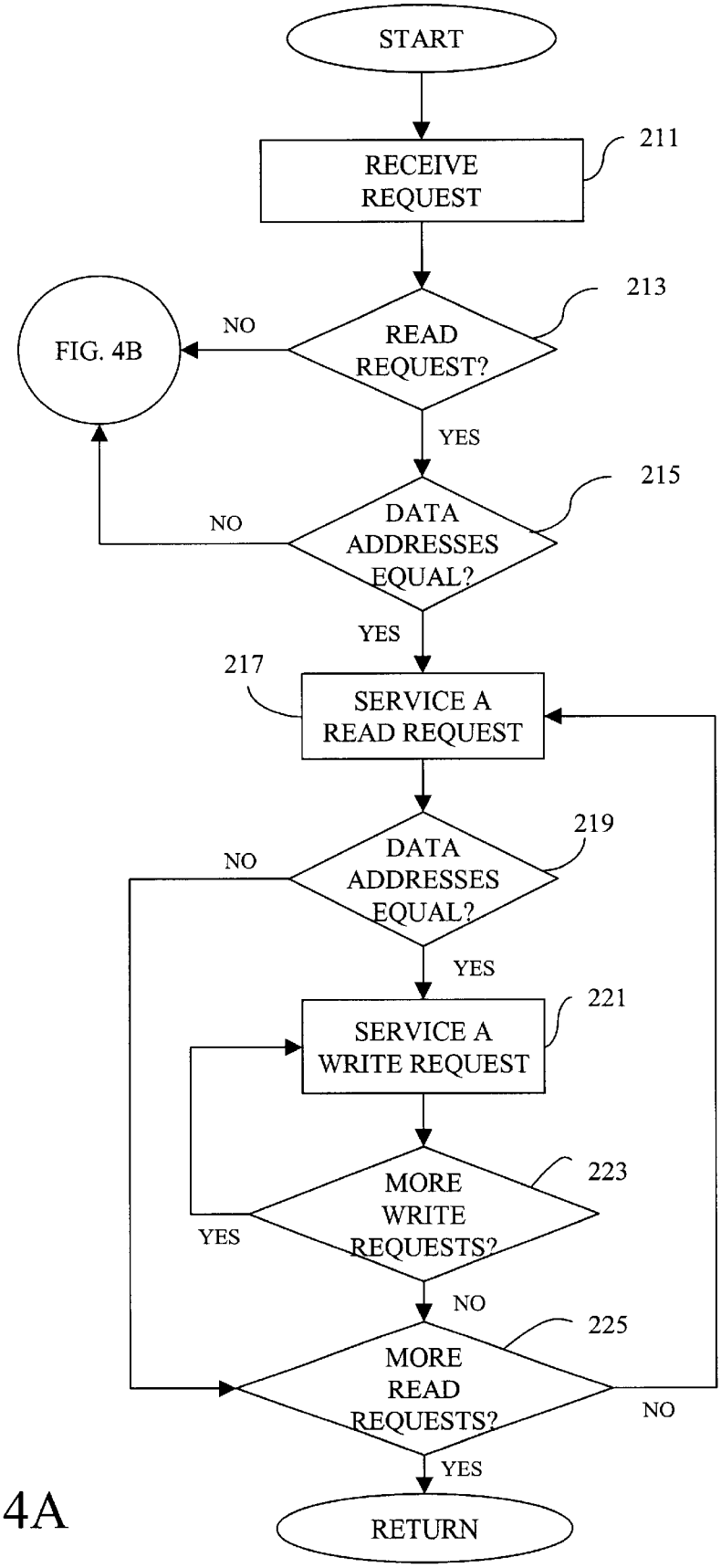
FIG. 4A is a flow diagram detailing a process of the present invention for performing z-buffer manipulations in a burst mode transfer environment.
Figure 4B:
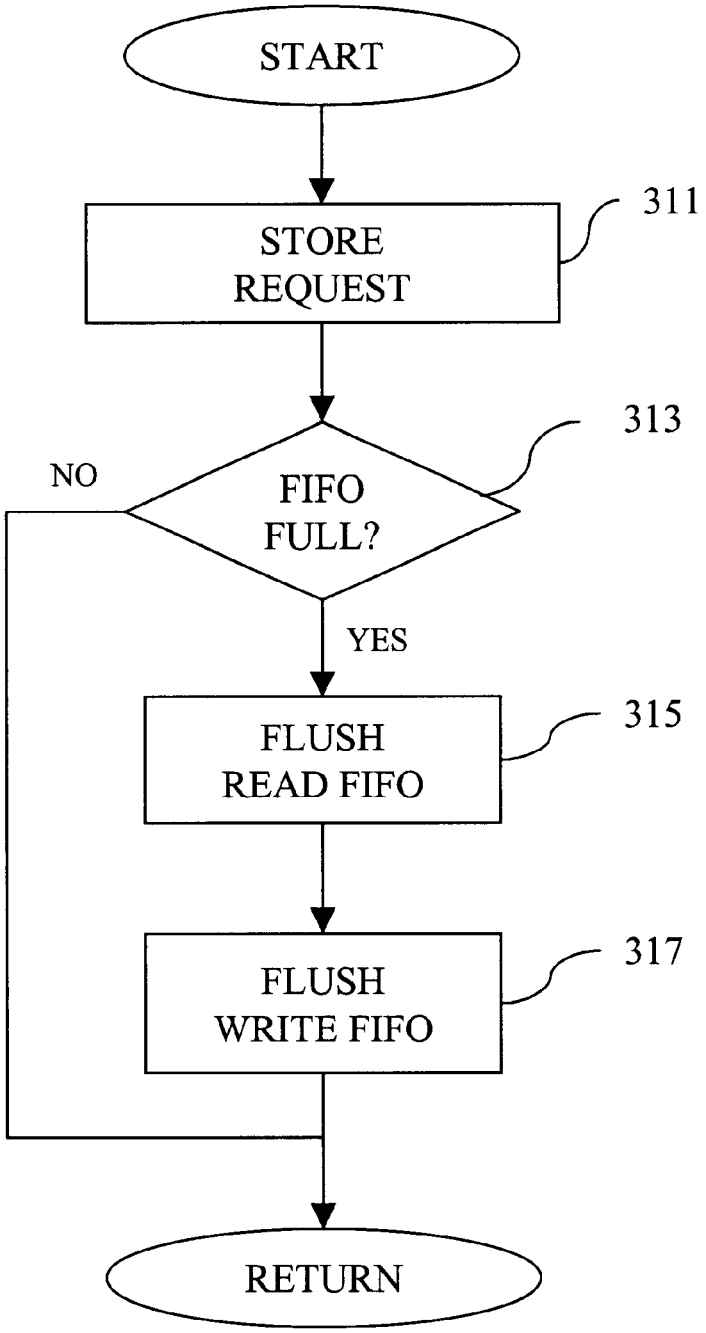
FIG. 4B is a flow diagram illustrating the sub-process associated with the z-buffer manipulations in FIG. 4A.

FIG. 4A illustrates one embodiment of the detailed process of boxes 113–117 in FIG. 3. In box 211, the process receives a request regarding z-buffer operations. In one embodiment, a read First In, First Out (FIFO) to store read requests and a write FIFO to store write requests are used by the process to perform the z-buffer operations. As one skilled in the art would recognize another type of data structure instead of a FIFO could be used. The read FIFO and write FIFO, in the embodiment described, are more fully described in reference to FIG. 6. The process determines, in box 213, if the received request is a read request. If the received request is not a read request, then the process continues as illustrated in FIG. 4B. However, if the received request is a read-request as determined by the process in box 213, then the process compares the address information in the received request to the address information in other read requests stored in the read FIFO, in box 215. If, in box 215, the process determines that the address information in the received request does not correspond to the address information in a read request stored in the read FIFO, then the process continues as illustrated in FIG. 4B. However, if, in box 215, the process determines that the address information in the received request equals the address information in a read request stored in the read FIFO, then the process in box 217 starts sequentially servicing the read FIFO. In one embodiment, the process sequentially services the read FIFO by fetching read requests off the read FIFO one at a time and in the same order in which the read requests were stored and by executing the fetched read requests. In box 219, the process examines the address information of the read request from the read FIFO.

If, in box 219, the process determines that the address information in a fetched read request equals the address information in the received read request (from box 211), then the process stops servicing the read FIFO and starts servicing the write FIFO in box 221. In one embodiment, the process sequentially services the write FIFO by fetching write requests off the write FIFO one at a time and in the same order in which the write requests were stored and by executing the fetched write requests. In box 223, the process determines if the write FIFO storing the write requests is empty (i.e., there are no more write requests). If the write FIFO is empty, then the process, in box 225, determines if the read FIFO is empty. If the write FIFO is not empty then the process continues to box 221 to service another write request from the write FIFO.

If the process in box 225 determines that the read FIFO is empty, the process services the received request (box 211) and then returns. If the process in box 225 determines that the read FIFO is not empty then the process continues to box 217 and continues to service the read FIFO. Referring back to box 219, if the process determines that the address information in the fetched read request (box 217) does not equal the address information in the received read request (box 211), then the process continues to box 225 to determine if the read FIFO is empty.

If, in box 213, the process determines that the received request is not a read request the process continues to box 311 of the sub-process in FIG. 4B. Similarly, if the process, in box 215, determines that the address information of in the received request does not correspond to the address information in a read request stored in the read FIFO, the process continues to box 311 of the sub-process in FIG. 4B. In box 311, the sub-process stores the received request (box 213) from the process in FIG. 4A. If the received request is a read request, then the sub-process stores the read request in the read FIFO. Similarly, if the received request is a write request, then the sub-process stores the request in the write FIFO. In box 313, the sub-process determines if the write or read FIFOs are full. If the read and/or write FIFOs storing the requests are full, then the sub-process flushes or services each of the requests stored within the FIFOs. Starting with the read FIFO, the sub-process in box 315 services each of the requests stored in the read FIFO until the read FIFO is empty. In one embodiment, the process causes the read FIFO to transfer the requests to the memory unit interface in a burst mode transfer manner. In other words, read requests are transferred in bursts from the read FIFO to the memory unit interface. In box 317, the process similarly services each of the requests stored in the write FIFO until the write FIFO is empty and then the sub-process returns. In one embodiment, the process causes the write FIFO to transfer the requests to the memory unit interface in a burst mode transfer manner. In other words, write requests are transferred in bursts from the write FIFO to the memory unit interface.

Figure 5:
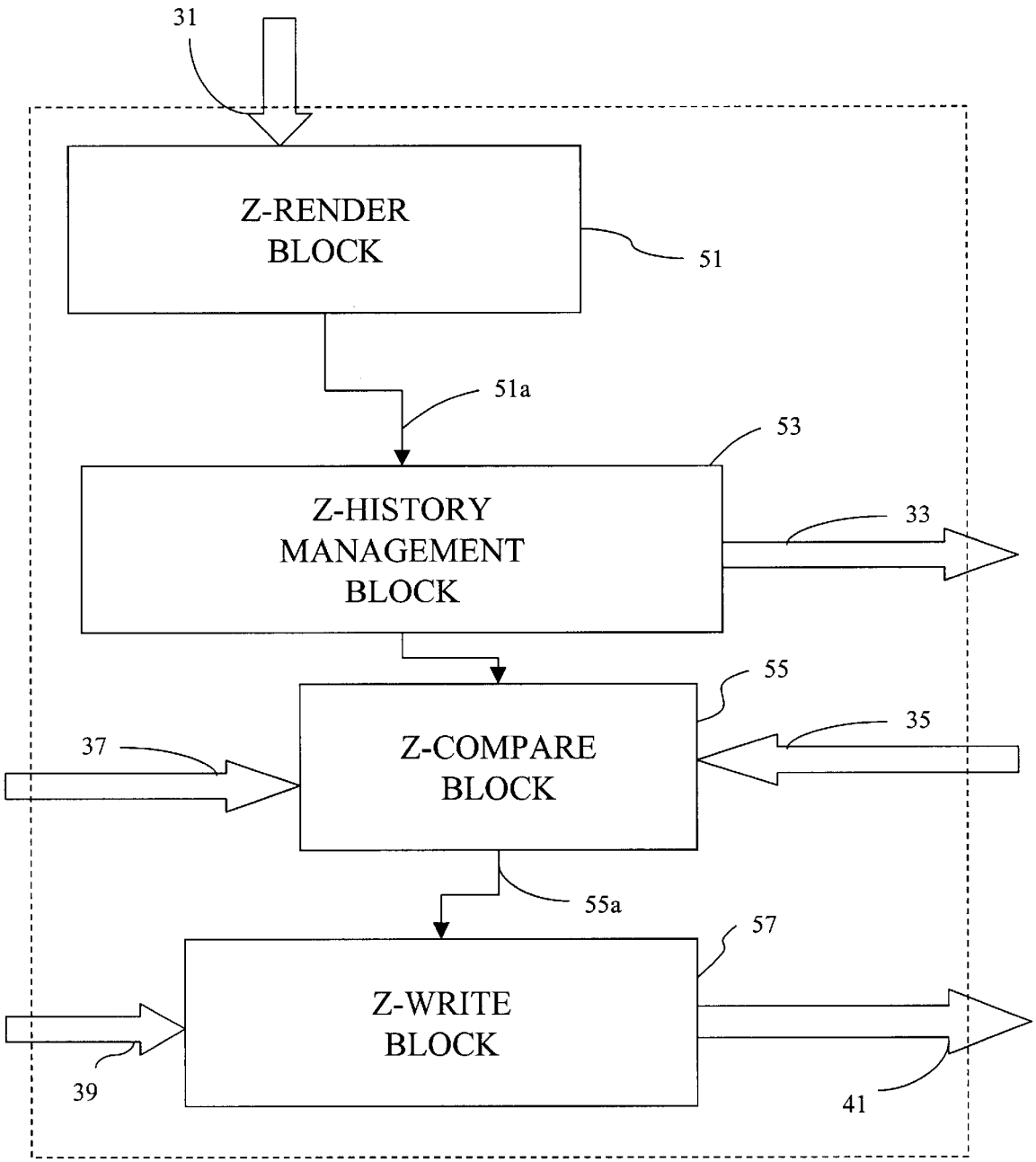
FIG. 5 illustrates a semi-schematic of one embodiment of the z-unit of the present invention.

FIG. 5 illustrates a semi-schematic of the z-unit of the present invention. The z-unit includes a z-render block 51, a z-history management block 53, a z-compare block 55 and a z-write block 57. In the described embodiment, three-dimensional objects are represented by a set of vertices defining triangle surfaces. However, those skilled in the art will appreciate using other types of polygons, such as circles, squares, pentagons, hexagons, and the like, to represent a three-dimensional object.

In accordance with an embodiment of the invention, a display screen of a display output device is partitioned into one or more display blocks. The depth characteristic of each display block is then explored. One exemplary screen is partitioned into display blocks of 16 pixels by 8 pixels (16×8). Each 16×8 display block, therefore, contains 128 pixels. Alternative dimensions may also be utilized, such as 8×4, 16×4, or 8×8 blocks. The graphics engine (FIG. 2) traverses each display block and sends command signals to the z-render block 51 based on the polygon being displayed. In one embodiment, using the received command signals 31, the z-render block 51 computes X and Y values for each pixel. Each pixel in a display block is associated with either a front layer or a back layer. The front layer is comprised of pixels associated with a foreground of the screen. The back layer is comprised of pixels associated with a background of the screen. If only one layer is present in the block, it is represented as the back layer instead of the front layer. Initially, a block is empty and all pixels belong to a background which is represented as the back layer.

Using the computed X and Y values the z-render block 51 generates a 24-bit offset address. In another embodiment, a by-pass mode is provided in the z-render block 51. When the by-pass mode is enabled in the z-render block 51, the graphics engine provides X and Y values directly to the z-render block 51. In this case, the z-render block generates the 24-bit offset address directly and without any computation by the z-render block.

The z-history management block 53 receives z-addresses 51*a* from the z-render block 51. The z-history management block ensures that previous data contained in the z-buffer is not overwritten inadvertently. In one embodiment, the z-history management block maintains the data coherency of the z-buffer by controlling and transmitting the z-read requests 33 to the z-buffer. In other words, the z-history management block ensures that previous data is stored in the z-buffer before any new data is read or fetched out.

The z-compare block 55 performs z-comparisons. In other words, as a new triangle is introduced to the block for display, the z-compare block compares the z-value range for the new triangle with the z-value ranges of the front and/or back layers. In this way, the z-compare block can determine the pixels in the new triangle which are visible and the pixels that are obscured by the other triangles.

The z-compare block receives previous or "old" z-data 35 from the memory interface unit (FIG. 2) and current z-data 37 from the auxiliary FIFO (FIG. 2). The current z-data from the auxiliary FIFO is compared to the z data from the memory interface unit. If enabled, the z-compare block 55 also performs stencil and window identification comparisons.

The z-write block 57 receives resulting z-data 55*a* from the z-compare block 55. The z-write block also receives Z write back addresses, data and byte masks 39. The z-write block selects the Z compare data or back end data. The z-write block then packs the z data 41 for transfer to the memory interface unit for storage in the z-buffer.

Figure 6:
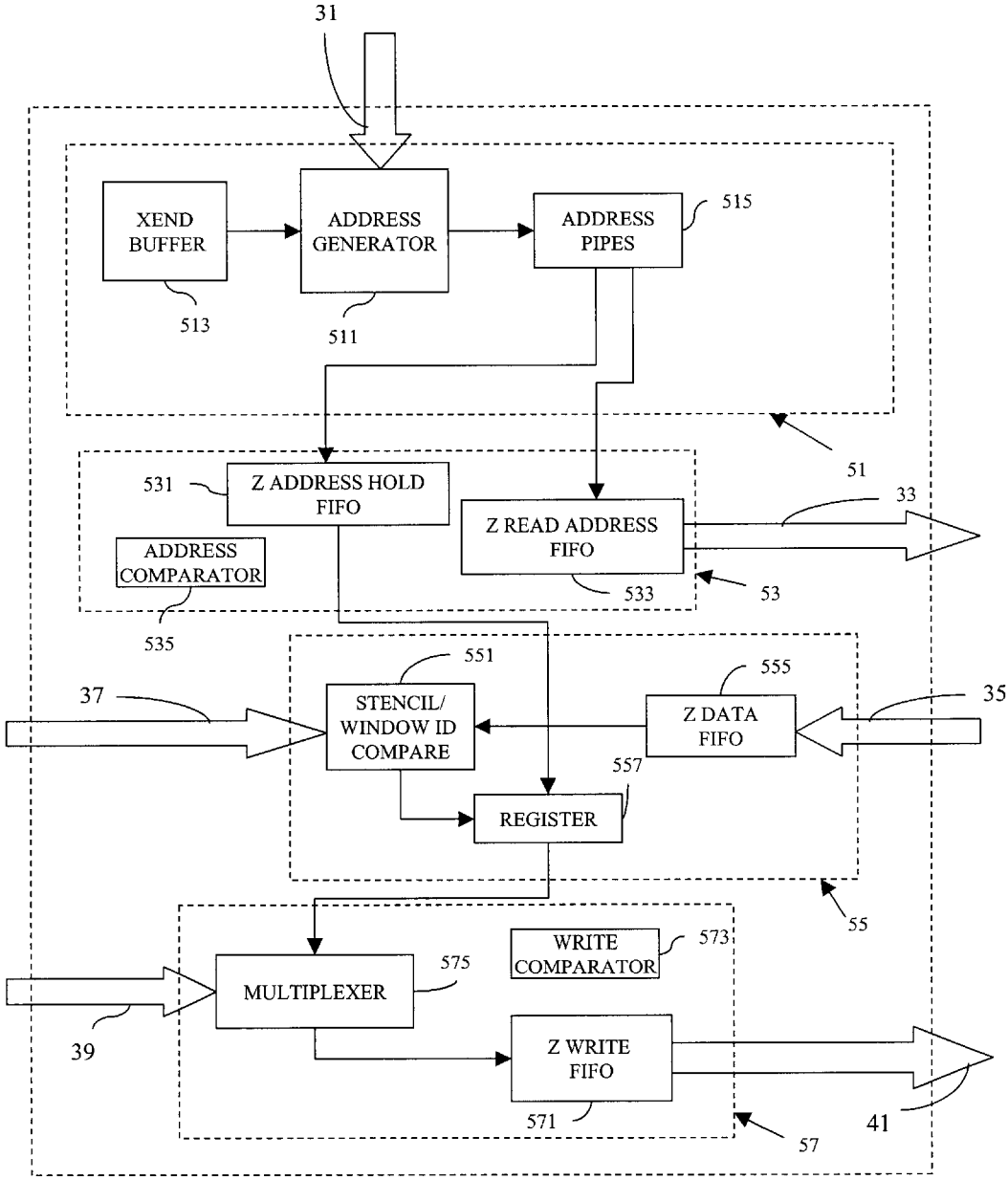
FIG. 6 illustrates a detailed semi-schematic view of one embodiment of the z-unit in the present invention.

FIG. 6 illustrates a detailed semi-schematic view of the z-render block 51, the z-history management block 53, the z-compare block 55 and the z-write block 57. The z-render block includes an address generator 511. In the embodiment described, the z-address generator 511 receives a 16-bit mask from the graphics engine (FIG. 2). The 16-bit mask provides information on which pixel is being addressed in a request. The address generator 511 computes X and Y values for each pixel on a scan line. A scan line is a horizontal or sequence of pixels having a constant and identical Y-values. A Xend buffer 513 stores the left and right end points or pixels of each polygon, e.g., triangle, of the scan line. Using the left and right end pixels of each scan line, the address generator 511 computes the X and Y values. From the X and Y values, the address generator 511 computes the 24-bit offset address. Therefore, the 24-bit offset address allows the X and Y values, two-dimensional values, to be represented in a linear format. As linear addresses, each pixel for each scan line is easily stored and identified in memory.

In a tile memory organization for a screen having a tile dimension of 64 pixels by 32 pixels (64×32) and having 16 bits per pixels (bpp), the 24-bit offset address is calculated as illustrated in Table 1.

TABLE 1

| Offset Bits | Computations |
|---|---|
| 23–12 | y[10:5] * WIT + x[10:6] |
| 11–10 | y[4:3] |
| 9–7 | x[5:3] |
| 6–4 | y[2:0] |
| 3–1 | x[2:0] |
| 0 | 0 |

Similarly, in a tile memory organization for a screen having a tile dimension of 32 bpp and having a tile dimension of 32 pixels by 32 pixels (32×32), the 24-bit offset address is calculated as illustrated in Table 2.

TABLE 2

| Offset Bits | Computations |
|---|---|
| 23–12 | y[10:5] * WIT + x[10:5] |
| 11–10 | y[4:3] |
| 9–8 | x[4:3] |
| 7–5 | y[2:0] |
| 4–2 | x[2:0] |
| 1 | 0 |
| 0 | 0 |

In Table 1 and 2, WIT is the width of a tile. The conventions of x[2:0] and y[2:0] refers to bits 0–2 of the X value and bits 0–2 of the Y value, respectively. The generated 24-bit offset address is then forwarded through z-address pipes 515 to generate z addresses that correspond to memory locations within the z-buffer (FIG. 2). The z-address pipes are buffers and allow z-address generation to continue even when the memory is not available for any read requests, specifically z-buffer requests. The z addresses are then forwarded to the z-history management block 53.

The z-history management block receives the z addresses and temporarily stores the z addresses in a z-address hold FIFO 531 and a z-address read FIFO 533. In one embodiment, the z-address hold FIFO is 48 bits by 30 bits and the z-address read FIFO is 32 bits by 32 bits. The z-address hold FIFO is slightly larger than the z-address read FIFO to allow for delays in any request for data and the receipt of the requested data and to allow data to be written back to the z-buffer. An address comparator 535 is also included in the z-history management. The address comparator 535 compares each z address received from the z-render block 51 to the z addresses contained in the z-address hold FIFO 531. If the address comparator detects that the address generated corresponds to a z address (for the same pixel (bit masks) ) contained in the z-address hold FIFO 531, the address comparator 535 generates a "hit" signal.

When a "hit" signal is generated, the z address received from the z-render block 51 is not stored in either the z-address hold FIFO 531 or the z-address read FIFO 533. The "hit" signal, through a write comparator 573, causes a z write FIFO 571 to be emptied. In one embodiment, the write FIFO is emptied by transferring the requests stored in the z write FIFO to the memory unit interface in a burst mode transfer manner. The z write FIFO is described in greater detail below. Once the z write FIFO is flushed, then the z address received from the z-render block 51 is stored in both the z-address hold FIFO 531 and the z-address read FIFO 533. From the z-address read FIFO 533, the z-read requests 33 are transmitted to the memory interface unit (not shown) in a burst mode transfer manner.

The z-compare block 55 includes a stencil/window identification (ID) compare 551 and a z-data FIFO 553. The z-data FIFO receives and temporarily stores previous or "old" z-data from the z-buffer through the memory unit interface (FIG. 2). In one embodiment, the z-data FIFO 553 is 32 bits by 128 bits. The stencil/window ID compare 551 receives current z-data for the current scan line from the auxiliary FIFO (FIG. 2). The current z-data is compared to the previous z-data stored in the z-data FIFO 553. Based on two concurrent z data comparisons performed by the stencil/window ID compare, two z values for two adjacent pixels in the current scan line are generated.

Based on settings of a series of buffer control registers (not shown), the z-compare block performs-different stencil and window functions or none of these functions. In one embodiment, a stencil value is 8 bits and using the stencil value along with the z-buffer a stencil operation is performed. For example, real-time shadowing is performed. Alternatively, the stencil operation provides the ability to turn on or off a certain effect such as fading between two images.

The z-register 557 collects the z-data and forwards the z-data information to a multiplexer 573. The multiplexer 573 is included in the z write block 57. The z write block also includes a write comparator 575 and the z write FIFO 571. The multiplexer 575 receives z write back addresses and data and byte masks. The multiplexer 575 selects either the z data from the z-register 557 or the back end data from the graphics engine (FIG. 2) based on the z-buffering process ("hidden removal process"). The z data and z addresses selected by the multiplexer 575 are stored into the z write FIFO 571. The z write FIFO 571 packs the z data for sending to the memory interface unit (FIG. 2). In one embodiment, the data is packed into 128 bits for sending to the memory interface unit in a burst mode transfer manner.

Accordingly, there has been brought to the art of computer graphics display systems, a system and method that allows both z-buffering using atomic operations to operate in a burst mode transfer storage environment. Although this invention has been described in certain specific embodiments, those skilled in the art will have no difficulty devising variations which in no way depart from the scope and spirit of the present invention. For instance, instead of only using two FIFOs corresponding to a read FIFO and a write FIFO, one skilled in the art might appreciate using three or more FIFOs for managing z-buffer manipulations. A person skilled in the art will also appreciate that the z-range buffer will have to be modified to store the minimum and maximum z-values of all the layers used.

It is therefore to be understood that this invention may be practiced otherwise than is specifically described. Thus, the present embodiments of the invention should be considered in all respects as illustrative and not restrictive, the scope of the invention to be indicated by the appended claims and their equivalents rather than the foregoing description.

What is claimed is:

1. A method of performing non-divisible operations, a non-divisible operation including a read request and a write request, in a burst mode transfer storage environment of a graphics system, the method comprising:

receiving an individual read request in a non-divisible operation, the received individual read request containing address information;

comparing address information in the received read request to address information contained in previous read requests received;

servicing previous read requests when the address information contained in the received individual read request corresponds to the address information contained in one of the previous read requests;

halting the servicing of the previous read requests when the one of the previous read requests is serviced; and servicing previous write requests in a second buffer until the second buffer is empty.

2. The method of claim 1 further comprising:

writing a plurality of depth values to a z-buffer based on the serviced write requests; and fetching a plurality of depth values from the z-buffer based on the serviced read requests.

3. The method of claim 2 further comprising:

comparing a plurality of depth values currently received to the plurality of depth values that are fetched; and transmitting a plurality of depth values to update the z-buffer.

4. The method of claim 3 further comprising:

receiving stencil command signals; and performing stencil operations based on the stencil command signals received.

5. A method of performing non-divisible operations in a burst mode transfer storage environment of a graphics system, the method comprising:

receiving a plurality of non-divisible operations that include a plurality of read requests and a plurality of write requests, each of the plurality of read requests containing address information;

servicing the plurality of read requests when address information in a first one of the plurality of read requests corresponds to address information contained in a second one of the plurality of read requests;

halting the servicing of the plurality of read requests when the first one of the plurality of read requests is serviced;

servicing the plurality of write requests; and restarting the servicing of the plurality of read requests when all the plurality of write requests have been serviced.

6. The method of claim 5 further comprising:

writing a plurality of depth values to a z-buffer based on the serviced write requests; and fetching a plurality of depth values from the z-buffer based on the serviced read requests.

7. The method of claim 6 further comprising:

comparing a plurality of depth values currently received to the plurality of depth values that are fetched; and transmitting a plurality of depth values to update the z-buffer.

8. The method of claim 7 further comprising:

receiving stencil command signals; and performing stencil operations based on the stencil command signals received.

9. A z-unit coupled to a graphics engine and to a memory, comprising:

a z-render block generating addresses from signals received from a graphics engine;

a z-read buffer storing read addresses;

a z-write buffer storing write addresses; and a z-history block tracking the generated addresses to ensure that memory locations corresponding to the write addresses are updated in a predetermined order in relation to the read addresses.

10. The z-unit of claim 9 wherein the z-history block further comprises a comparator that compares the generated addresses to the read addresses in the read buffer and services the write buffer until the write buffer is empty when one of the generated addresses corresponds to one of the read addresses in the read buffer.

11. The z-unit of claim 10 further comprising a z-compare block that performs z-comparisons to selectively update a z-buffer.

12. The z-unit of claim 11 further comprising a z-write block that packs z-data to be written to the z-buffer.

13. A three-dimensional graphics system, comprising:

a memory, including a z-buffer, the memory configured to transfer data in groups corresponding to a memory bus width;

a graphics engine coupled to the memory and configured to initiate non-divisible operations; and a z-unit coupled to the graphics engine and to the memory and configured to interpret and execute the non-divisible operations, when the operations are received in a burst mode transfer manner, as if the operations had been received sequentially.

14. The three-dimensional graphics system of claim 13 where the z-unit further comprises:

z-render block generating addresses from signals received from a graphics engine;

z-read buffer storing read addresses;

z-write buffer storing write addresses; and z-history block tracking the generated addresses to ensure that memory corresponding to the write addresses are updated in a predetermined order in relation to the read addresses.

15. The three-dimensional graphics system of claim 14 wherein the z-history block further comprises a comparator that compares the generated addresses to the read addresses in the read buffer and services the write buffer until the write buffer is empty when one of the generated addresses corresponds to one of the read addresses in the read buffer.

16. The three-dimensional graphics system of claim 15 further comprising a z-compare block that performs z-comparisons to selectively update a z-buffer.

* * * * *